US006388677B1

(12) United States Patent
Doyen et al.

(10) Patent No.: US 6,388,677 B1
(45) Date of Patent: May 14, 2002

(54) ADDRESSING PROCESS FOR A PLASMA DISPLAY BASED ON REPEATING BITS ON ONE OR MORE LINES

(75) Inventors: Didier Doyen, La Bouexière; Eric Benoît, Eybens; Jacques Deschamps, Grenoble, all of (FR); Gérard Rilly, Unterkirnach (DE)

(73) Assignee: Thomson multimedia, Boulogne-Billancourt (FR)

( * ) Notice: Subject to any disclaimer, the term of this patent is extended or adjusted under 35 U.S.C. 154(b) by 0 days.

(21) Appl. No.: 09/061,419

(22) Filed: Apr. 16, 1998

(30) Foreign Application Priority Data

Apr. 25, 1997 (FR) ..... 97 05166

(51) Int. Cl.[7] ..... G09G 3/00
(52) U.S. Cl. ..... 345/690
(58) Field of Search ..... 345/147–180, 345/60, 63, 55, 690; 348/687, 624, 797, 800, 910

(56) References Cited

U.S. PATENT DOCUMENTS 3,935,379 A * 1/1976 Thornburg et al. ..... 178/6
5,086,257 A * 2/1992 Gay et al. ..... 315/169.4
5,555,000 A * 9/1996 Sarrasin et al. ..... 345/75
5,619,228 A * 4/1997 Doherty ..... 345/148
5,673,060 A * 9/1997 Blaxtan et al. ..... 345/84
5,969,710 A * 10/1999 Doherty ..... 345/148

FOREIGN PATENT DOCUMENTS

EP 698 874 A1 2/1996 ..... G09G/3/36
EP 792 373 A2 3/1997 ..... G09G/3/28
WO WO95/27970 10/1995 ..... G09G/3/34

* cited by examiner

*Primary Examiner*—Almis R. Jankus
(74) *Attorney, Agent, or Firm*—Joseph S. Tripoli; Harvey D. Fried; Sammy S. Henig

(57) ABSTRACT

The device comprising a video processing circuit (7) for processing the video data received, a correspondence memory (8) for transcoding these data, a video memory (9) for storing the transcoded data, the video memory being linked to column drivers (10) in order to control the column addressing of the plasma panel on the basis of column control words, a control circuit (11) for the line drivers (12), is characterized in that the control circuit for the line drivers simultaneously selects at least two successive lines during the transmission by the column drivers (10) of at least one of the bits of the column control words relating to one of these lines.

9 Claims, 2 Drawing Sheets

ADDRESSING PROCESS FOR A PLASMA DISPLAY BASED ON REPEATING BITS ON ONE OR MORE LINES

FIELD OF THE INVENTION

The invention relates to an addressing process for plasma panels based on repeating bits on one or more lines.

BACKGROUND OF THE INVENTION

On plasma displays, the grey level is not produced in a conventional manner using amplitude modulation of the signal but rather temporal modulation of this signal, by exciting the corresponding pixel for a greater or lesser time depending on the level desired. It is the phenomenon of integration by the eye which makes it possible to render this grey level. This integration is performed during the frame scan time.

The eye actually integrates much faster than the frame duration and is therefore liable to perceive, in cases of particular transition of the addressing bits, variations in level which do not reflect reality. Contour defects or "contouring" as it is known, may thus appear in the moving images. These defects may be compared to poor temporal restitution of the grey level. More generally, false colours appear on the contours of objects, each of the cells of a colour component possibly being subject to this phenomenon. This phenomenon is even more harmful when it occurs in relatively homogeneous zones.

SUMMARY OF THE INVENTION

The object of the invention is to overcome the aforementioned drawbacks.

To this end, the subject of the invention is a process for addressing cells arranged as a matrix array, each cell being situated at the intersection of a line and a column, the array having line inputs and column inputs for displaying grey levels defined by video words making up a digital video signal, the column inputs each receiving a control word for this column corresponding to the video word relating, for this column, to the addressed line, this word being made up of n bits transmitted sequentially, each bit triggering or not triggering, depending on its state, the selection of the cell of the addressed line and of the corresponding column for a time proportional to the weight of this bit within the word, characterized in that it consists in simultaneously selecting at least two lines for at least one of the bits of the column control word relating to one of the two lines.

According to a particular embodiment, the process is characterized in that it also carries out a transcoding of the digital video signals into column control words such that at least one of the weights of the video control words is different from a power of two, the word retaining a maximum value equal to that of the words of the video signal, in such a way that words of the video signal can correspond to different column control words, these control words then being chosen as a function of the identity of the bit or bits in respect of which at least two lines are simultaneously addressed.

The invention also relates to a device for implementing the process comprising a video processing circuit for processing the video data received, a correspondence memory for transcoding these data, a video memory for storing the transcoded data, the video memory being linked to column drivers in order to control the column addressing of the plasma panel on the basis of column control words, a control circuit for the line drivers, characterized in that the control circuit for the line drivers simultaneously selects at least two successive lines during the transmission by the column drivers of at least one of the bits of the column control words relating to one of these lines.

By virtue of this invention, the contouring defect is strongly attenuated if not eliminated. The process according to the invention is simple and inexpensive to embody and can be applied to any type of plasma panel.

According to the particular embodiment, the errors in copying from one line to another are considerably reduced and the overbrightness defect is also attenuated.

BRIEF DESCRIPTION OF THE DRAWINGS

Other features and advantages of the invention will emerge clearly in the following description given by way of non-limiting example in conjunction with the appended figures which represent.

DESCRIPTION OF THE PREFERRED EMBODIMENT

Figure 1:
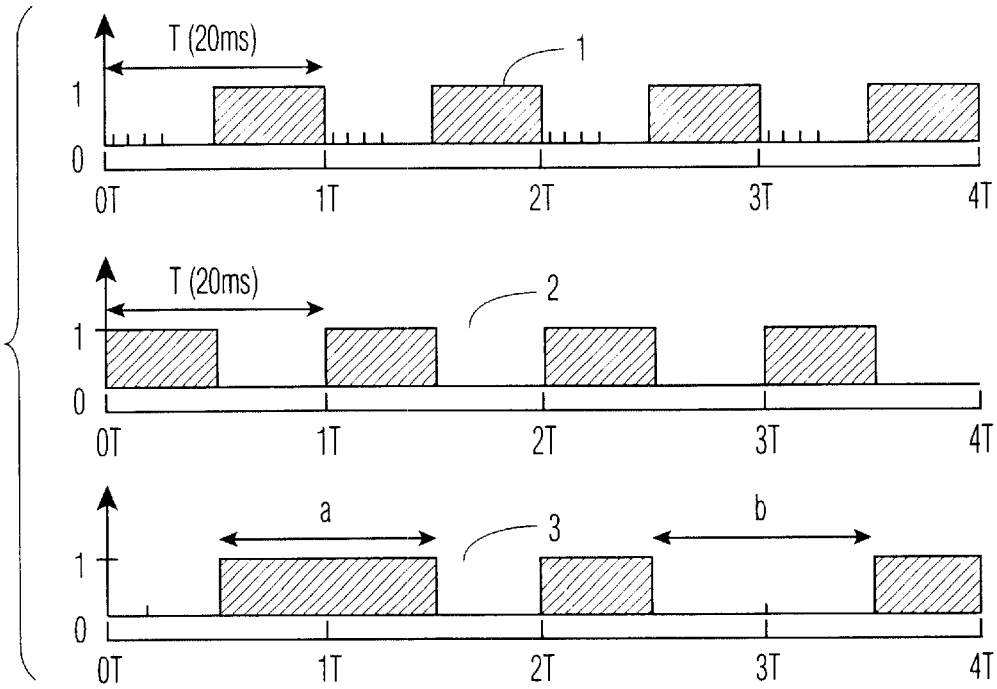
FIG. 1, a timing diagram explaining the phenomenon of contouring.

A plasma display panel consists of two glass panes separated by about a hundred microns. This space is filled with a gaseous mixture containing neon and xenon. When this gas is excited electrically, the electrons orbiting the nuclei are extracted and become free. The term "plasma" denotes this gas in the excited state. Electrodes are silk-screen printed on each of the two panes of the panel, line electrodes for one pane and column electrodes for the other pane. The number of line and column electrodes corresponds to the definition of the panel. During manufacture, a barrier system is set in place which makes it possible physically to delimit the cells of the panel and to limit the phenomena of the diffusing of one colour into another. Each crossover of a column electrode and a line electrode will correspond to a video cell containing a volume of gas. A cell will be referred to as red, green or blue depending on the luminophore deposit with which it will be covered. Since a video pixel is made up of a triplet of cells (one red, one green and one blue), there are therefore three times as many column electrodes as pixels in a line. On the other hand, the number of line electrodes is equal to the number of lines in the panel. Given this matrix architecture, a potential difference merely needs to be applied to the crossover of a line electrode and a column electrode in order to excite a specific cell and thus obtain, point-wise, a gas in the plasma state. The UV generated when exciting the gas will bombard the red, green or blue luminophores and thus give a red, green or blue illuminated cell.

A line of the plasma panel is addressed as many times as are defined therein sub-scans in the grey level information to be transmitted to the pixel, as explained later. The pixel is selected by transmitting a voltage termed a write pulse, by way of a driver, to the whole of the line corresponding to the selected pixel while the information corresponding to the grey-related value of the selected pixel is transmitted in parallel to all the electrodes of the column in which the pixel lies. All the columns are supplied simultaneously, each of them with a value corresponding to the pixel of this column.

With each bit of the grey level information there is associated a time information which therefore corresponds to the bit illumination time or more globally to the time between two writes: a 1 value for the bit of order 4 will thus correspond to the pixel being illuminated for a duration 4 times greater than the illumination corresponding to the bit of order 1. This hold time is defined by the time separating the write cue from an erase cue and corresponds to a hold voltage which specifically makes it possible to maintain the excitation of the cell after its addressing. For a grey level coded on n bits (the grey level for each of the components R G B is involved), the panel will be scanned n times in order to retranscribe this level, the duration of each of these sub-scans being proportional to the bit which it represents. By integration, the eye converts this "global" duration corresponding to the n bits into a value of illumination level. Sequential scanning of each of the bits of the binary word is therefore performed by applying a duration proportional to the weight. The addressing time of a pixel, for one bit, is the same irrespective of the weight of this bit, what changes is the illumination hold time for this bit.

Globally, a cell therefore possesses only two states: excited or non-excited. Therefore, unlike with a CRT, it is not possible to carry out analogue modulation of the light level emitted. In order to account for the various grey levels, it is necessary to perform temporal modulation of the duration of emission of the cell within the frame period (denoted T). This frame period is divided into as many sub-periods (sub-scans) as there are bits for coding the video (number of bits denoted n). It must be possible to reconstruct all the grey levels between 0 and 255 by combination on the basis of these n sub-periods. The observer's eye will integrate these n sub-periods over a frame period and thus recreate the desired grey level.

A panel is made up of Nl lines and Nc columns supplied by Nl line drivers and Nc column drivers. The generation of grey levels by temporal modulation requires that the panel be addressed n times for each pixel of each line. The matrix aspect of the panel will enable us to address all the pixels of a line simultaneously by sending an electrical pulse of level Vccy to the line driver. The signals transmitted to the columns are called column control words and relate to the video signal to be displayed, this relation being for example a transcoding dependent on the number of bits used. The video information corresponding to the bit of this column control word addressed at this instant (corresponding to a sub-scan) will be present on each of the columns and will be manifested as an electrical pulse of "binary" amplitude 0 or Vccx (indicative of the state of the coded bit). Conjugation of the two voltages Vccx and Vccy at each electrode crossover will or will not lead to excitation of the cell. This state of excitation will then be sustained over a duration proportional to the weight of the sub-scan performed. This operation will be repeated for all the lines (Nl) and for all the bits addressed (n). It is therefore necessary to address n×Nl lines over the duration of the frame, thus giving the following fundamental relation:

$$T \geqq n.N_l.t_{ad}$$

where $t_{ad}$ is the time required to address a line.

A sequencing algorithm makes it possible to address all the lines n times while, between each addressing, complying with the respective weight of the sub-scan performed.

Let us turn to FIG. 1 to provide a better explanation of the phenomenon of contouring.

In this figure, the abscissa axis represents time and is divided into frame periods of duration T. Each frame period is divided into sub-periods of time whose duration is proportional to the weight of the various sub-scans thus making it possible to define a video level to be displayed on the plasma display, (1, 2, 4, 8 . . . , 128) for a video quantized on 8 bits and an addressing possessing 8 sub-scans.

The ordinate axis represents the 0 or 1 level of the addressing bits during the corresponding frame periods, or stated otherwise the unlit or lit state of a cell as a function of time, for a given coding level.

Curve 1 corresponds to a coding of the value 128, curve 2 to a coding of the value 127 and curve 3 to a coding of the value 128 during the first frame and of the value 127 during the second frame and vice versa for the next two frames.

The principle of temporal modulation of the grey levels involves a temporal distribution of the n sub-scans which retranscribe the video over the 20 ms of the frame. If addressing on 8 sub-scans (n=8) is adopted, the transitions 127/128 and 128/127 entail a switching over of all the bits. Since the 8 sub-scans are distributed over the 20 ms of the frame, the eye by integrating the video asynchronously, causes black areas to appear, part b of curve 3 corresponding to a 0 level for the duration of two successive frames, and causes white areas to appear, part a of curve 3 corresponding to a 1 level for the duration of two successive frames.

The phenomenon of contouring shows up particularly in moving areas where there are strong transitions (contours of objects) or more generally switchovers at the level of the high weights in the coding of this video. In the case of a colour display, this is manifested by the appearance on the panel, in the region of these contours, of "false colours" due to erroneous interpretation of the triplet R G B. This phenomenon is therefore linked to the system for the temporal modulation of the level of the video and to the fact that the eye in its role as integrator gives rise to the appearance of incorrect contours.

A solution to this problem consists in coding the grey level to be transmitted on more bits than is theoretically necessary (8 to code 256 levels) and thus in defining more sub-scans so as to achieve better temporal distribution of the information. This is because, by increasing the number of sub-scans the respective weights of the sub-scans are decreased and the problems during their switchovers are limited. At the present time, given the characteristics of panels (number of lines Nl), and the time required to address a line (tad), it is possible to perform 10 sub-scans (n=10) in 20 ms. A transcoding of the grey level will for example be:

1 2 4 8 16 32 32 32 64 64.

The highest weights can therefore be 64 instead of 128.

The process according to the invention described below makes it possible to "free" sub-scans so as to perform this temporal distribution of the codes even more efficiently. This process consists in copying a bit from line 2n onto line 2n+1 by carrying out a common addressing between lines 2n and 2n+1 in respect of the relevant bit. Alternatively, it consists in using the same addressing time for the relevant bit, for lines 2n and 2n+1 and exciting or not exciting, depending on the value of this bit, the two corresponding cells.

By referring to relation (1) it may be observed that by carrying out such addressing, that is to say by decreasing Nl, it is possible to increase the value of n. The term tad is a hardware-related constraint.

Let us take an example:

Given a panel with 512 lines and 10 addressings for each line, 5120 addressings must be carried out during a frame.

If lines 2n and 2n+1 are addressed in common in respect of a particular bit, we shall have:

512×9+(512/2)=4864 addressings, i.e. 256 fewer addressings.

If this operation is repeated a second time while copying a second bit, we shall have:

512×8+(512/2)=4608 addressings, i.e. 512 fewer addressings

This therefore allows us the possibility of adding an extra addressing for all the lines.

By copying two bits from lines 2n to lines 2n+1, it is possible to perform 11 addressings for each line rather than 10. By extrapolating, copying 2*i bits provides a saving of i addressings per line.

The principle of copying a bit from one line onto the other can be performed on any bit whatsoever. However, it is more sensible to do it on the bits of low weight insofar as statistically the copying of a bit leads to an error in 50% of cases (fewer if the correlation existing between the video of line 2n and that of line 2n+1 is taken into account). The lower the weight, the smaller will be the error induced.

An example of an application is given below:

Let us again use the above code: 1 2 4 8 16 32 32 32 64 64.

If we copy the 4 low-order bits (1 2 4 8) we shall benefit from 2 extra bits. These bits can then be used to decrease the weight of the MSBs using the following code:

1(2n=2n+1) 2(2n=2n+1) 4(2n=2n+1) 8(2n=2n+1) 16 32 32 32 32 32 32 32.

It is thus possible to divide the weights of 64 by 2 and thus obtain only weights of 32 or less. Since the phenomenon of contouring appears during the switching over of the high weights, it will be greatly attenuated in this way.

The technique described above may lead to systematic errors when copying the bits. It is possible to minimize these errors by combining this technique with a rotating-code addressing process described below. The contouring and overbrightness problems can be simultaneously lessened using this combination.

Let us firstly recall the origin of the phenomenon of overbrightness.

The cells of the panel are addressed as complete lines, a write pulse being sent to the line electrode by the line drivers. The video information is, for its part, sent to the column drivers. At a given instant, the line driver must therefore deliver as much extra current to sustain the excitation as there are excited pixels in the line. Since the drivers are not perfect, their current-response is not constant as a function of the load demanded.

Figure 2:
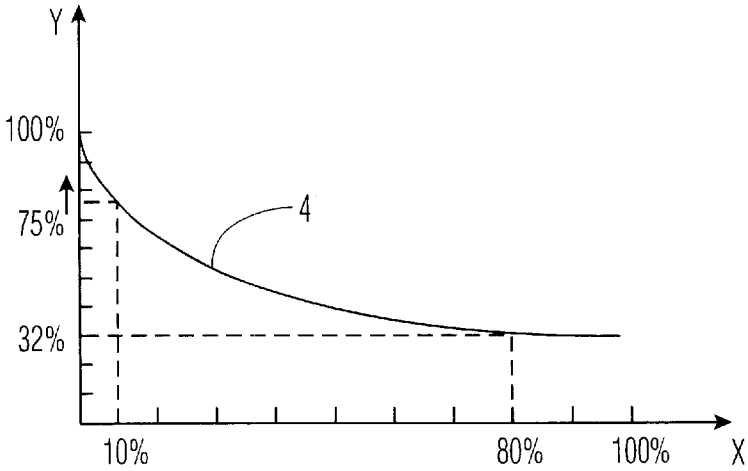
FIG. 2 PRIOR ART
FIG. 2, the luminance level restored by a line driver as a function of the percentage of excited cells in the line, FIG. 3, a simplified diagram of the control circuits of a plasma panel according to the invention.

FIG. 2 represents the shape of the grey level restored by the driver as a function of the number of excited cells and may be likened to the current response of a line driver as a function of this circuit's load. The abscissa axis x represents the number of excited cells in the line relative to the total number of cells in the line and the ordinate axis y, the value of the grey level restored by the driver relative to that restored for a driver load of nearly 0. By studying curve 2 it may be seen that for 10% of cells excited the driver responds to 75% whereas it responds to only 32% for 80% of cells excited.

An overbrightness phenomenon appears when the temporal distribution of the load is not uniform. For example, for an addressing on 8 sub-scans, if, in one frame period, the first 10 milliseconds are used to address the low-order sub-scans and the other 10 milliseconds the high-order sub-scan and if the relevant line contains 10% of cells receiving a coding level of 127 and 80% a level of 128, then the 127 level will be restored to 75% of its value and the 128 level to only 32%. Globally, the 10% of cells at the 127 level will appear brighter than the 80% of cells at the 128 level, hence the concept of overbrightness.

The principle of rotating-code addressing is now described.

The basic idea consists in employing a larger number of bits than that necessary for coding the video (8 bits to code 256 levels), for example 10 bits, and in utilizing these bits to code the 256 levels of the digital video signal, not in base two notation, but in a special notation. This is because, with the power of 2 code, it is possible to obtain only a single combination of bits for a given value to be coded. By contrast, a code can be chosen whose successive weights do not follow this geometric progression with common ratio 2 and which allows several combinations for the coding of one and the same value.

An example of a code which assigns a weight other than a power of 2 to some of the bits of the binary coding word could for example consist of the following string of values:

1 2 4 8 14 24 33 41 56 72, the sum of all these weights (corresponding to place values 1 to 10 of the binary coding word) still being 255.

Thus, for this code, for example the value 100 can be described in different ways:

$$\begin{aligned} 100 &= 72+24+4 \\ &= 72+14+8+4+2 \\ &= 56+41+2+1 \\ &= 56+33+8+2+1 \\ &= 56+24+14+4+2 \\ &= 41+33+24+2 \\ &= 41+33+14+8+4 \end{aligned}$$

This gives 7 different codes for the same value. Since the addressing of these 10 sub-scans is spread over the 20 ms of the frame, it will therefore be possible, depending on the code chosen, to distribute the load equitably between the various codes, and to change the code from one pixel to another of the same line for one and the same value of grey level.

The bit-repetition addressing process, which is the subject of the present patent application, makes it possible to benefit from extra bits in order to distribute the weight of the MSBs if information is copied from line 2n to line 2n+1. The rotating-code addressing process, which requires extra bits, affords us several coding possibilities for a given video value.

A combination of the two processes makes it possible to improve the efficiency of each of them and very greatly to lessen the aforementioned drawbacks. Thus, the bits can be copied between lines 2n and 2n+1 as a function of the content of the video, rather than systematically. The copied bits are then chosen in such a way as to minimize the errors introduced by this copying.

A first example is given below.

Let us start from the result, namely that there are 12 bits with which to code the video. These 12 bits mean that there must be 4 bits in common between lines 2n and 2n+1. Let us take the following 12-bit code:

30 1 2 4 6 10 14 18 24 32 40 48 56.

From these 12 bits 4 bits are chosen which will be common to lines 2n and 2n+1, i.e. for example the bits: 24 14 6 2.

The principle of rotating-code addressing consists in coding lines 2n and 2n+1 in such a way as to obtain the same states for the 4 chosen bits.

Suppose the value 34 is to be coded in line 2n and the value 54 in line 2n+1. The values of the common bits with weights 24, 14, 6, 2 are given in brackets.

34 = 32 + 2 (0001)
24 + 6 + 4 (1010)
24 + 10 (1000)
18 + 10 + 6 (0010)
18 + 14 + 2 (0101)
18 + 10 + 4 + 2 (0001)
14 + 10 + 6 + 4 (0110)

54 = 48 + 6 (0010)
48 + 4 + 2 (0001)
40 + 14 (0100)
40 + 10 + 4 (0000)
32 + 18 + 4 (0000)
32 + 14 + 6 + 2 (0111)
32 + 10 + 6 + 4 + 2 (0011)
24 + 18 + 10 + 2 (1001)
24 + 18 + 6 + 4 + 2 (1011)
24 + 14 + 10 + 6 (1110)
24 + 14 + 10 + 4 + 2 (1101)
18 + 14 + 10 + 6 + 4 + 2 (0111)

The various coding possibilities whereby the four common bits may be identical are:

(32+2) (0001) and (48+4+2) (0001)

or (18+10+4+2) (0001) and (48+4+2) (0001)

or (18+10+6) (0010) and (48+6) (0010).

It is therefore possible in this case to find a pair of codes (here 3 pairs) which are suitable, that is to say for which the rotating-code addressing will then lead to no error.

A second example, the coding of the value 34 for line 2n and the value 32 for line 2n+1 is given below.

34 = 32 + 2 (0001)
24 + 6 + 4 (1010)
24 + 10 (1000)
18 + 10 + 6 (0010)
18 + 14 + 2 (0101)
18 + 10 + 4 + 2 (0001)
14 + 10 + 6 + 4 (0110)

32 = 32 (0000)
24 + 6 + 2 (1011)
18 + 14 (0100)
18 + 10 + 4 (0000)
14 + 10 + 6 + 2 (0111)

When there is no coding possibility for obtaining the four common bits identical, the aim will be to find the pair of codes which is closest to a possible combination. In this case the pair 33 (0000) and 32 (0000) will be adopted, i.e. an error of 1 LSB. The error will therefore no longer be systematic and with amplitude proportional to the number of bits copied, but dependent on the 2 video levels and the bigger the discrepancy between the two terms, the bigger it will be.

Statistically in our example, it will be possible to code more than 90% of the pairs without errors. For the remaining 10%, the aim will be to minimize the error as a function of the respective levels of the video.

When there are several coding possibilities, an advantageous solution consists in selecting the words or pairs of words which possess the most 1 bits and, from these words, that or the pair whose high-order 1 bit has the least weight, while considering the lower high-order bits if there is equality.

By virtue of this selection:

- the load of the driver is distributed over a maximum number of bits, thus reducing the overbrightness effects;
- the switchovers of the bits with high weight are minimized thus reducing the contouring effects.

The hardware construction of the device is also simplified as compared with that based on choosing randomly from the coding possibilities when distributing the line driver's load.

In the example given earlier relating to the coding of the value 34 for one line and the value 54 for the following line, the pair:

18+10+4+2 and 48+4+2 will thus be chosen from the three coding possibilities.

Figure 3:
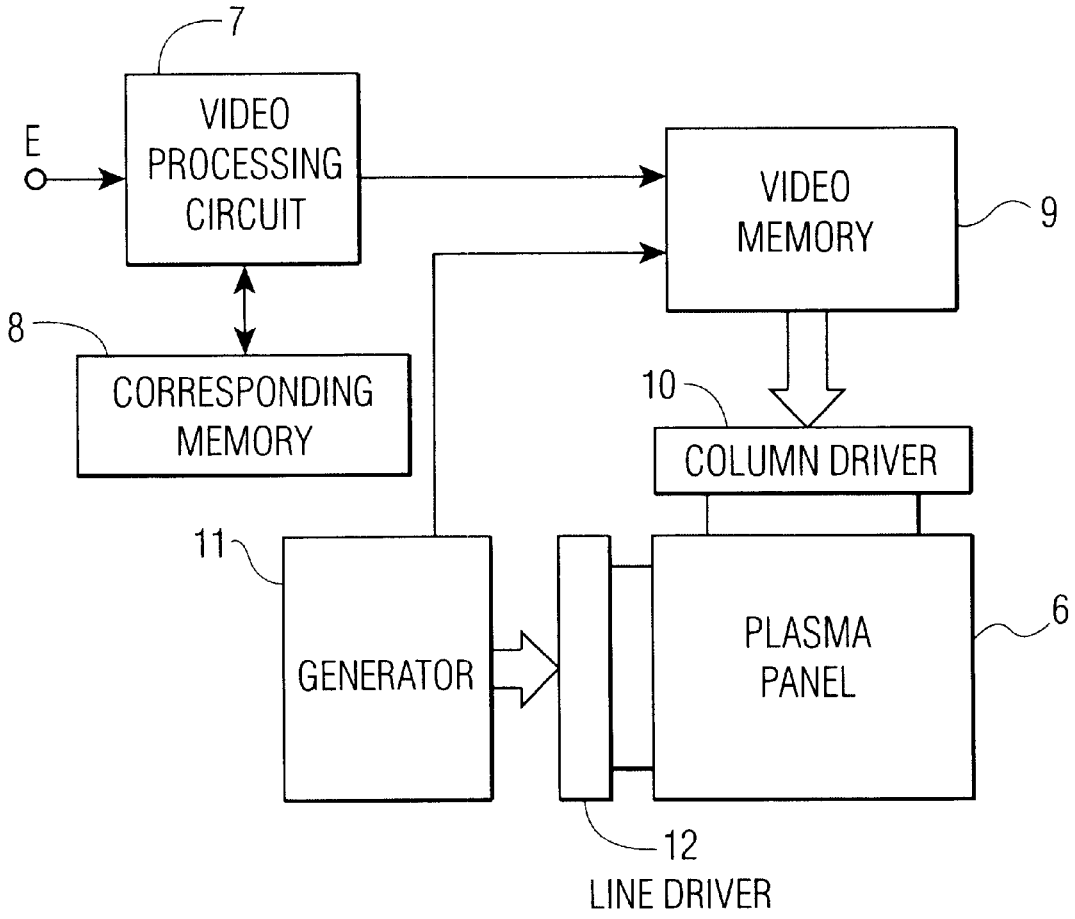

FIG. 3 represents a simplified diagram of the control circuits of a plasma panel 6.

The digital video information arrives at the input E of the device which is also the input of a video processing circuit 7. This circuit is connected to a correspondence memory 8 and the input of a video memory 9 which will transmit the stored information to the input of a circuit 10 which groups together the column drivers.

A scan generator 11 transmits synchronization information to the video memory 9 and controls a circuit 12 which groups together the line drivers.

The video information coded on 8 bits and received on the input E of the device is thus processed by the processor. The latter exchanges these data with the memory or correspondence table 8 which, depending on the values of the video words sent as addresses, will deliver as data, words coded on 10 bits whose weights will have been defined beforehand. These words are then transmitted to the video memory 9 which stores them so as to deliver the successive bits of the column control words to the column drivers, in synchronization with the line scan.

The scan generator 11 carries out, for the duration of a frame and by way of the line drivers 12, the line scan of the display, ten sub-scans per line, each sub-scan corresponding to one bit of the column control word. The circuit 12 delivers the addressing voltage and also the holding voltage for the duration corresponding to the sub-scan relating to the weight of the bit sent on the columns in respect of this addressing. During one or more predefined sub-scans, for example of the lines 2n, the scan generator 11 simultaneously controls or selects the lines 2n and 2n+1. The transcoding on the basis of the correspondence table 8 is defined by taking the sub-scans into account, that is to say the bits of the column control words for which the lines are grouped together. Greater flexibility of operation is obtained by linking the scan control circuit 11 to the micro-processor 7, which can thus manage the line scan control as a function of the transcoding carried out.

Of course, the above description assumed a line selection of the plasma panel for a transmission of video information on the column inputs of the display, but other types of addressing could be envisaged, for example by reversing the function of the lines and columns without the process departing from the field of the invention.

Clearly, the invention is not limited by the number of bits which quantize the digital video signal to be displayed, nor the number of sub-scans.

It may be applied equally to any type of display or device with matrix addressing which utilizes modulation of temporal type for the displaying of luminance or grey levels corresponding to each of the three components R G B. The cells of this device or matrix array with line inputs and column inputs, here the term cell being taken in the broad sense of elements at the intersection of the lines and columns, may be cells of plasma panels or else micromirrors of micromirror circuits. Instead of emitting light directly, these micromirrors reflect received light in a point-wise manner (a cell corresponding to a micromirror), when they are selected. Their addressing in respect of selection is then identical to the addressing of the cells of plasma panels such as is described in the present application.

What is claimed is:

1. A method for addressing cells arranged as a matrix array, each cell being situated at the intersection of a line and a column, the array having line inputs and column inputs for displaying grey levels defined by video words making up a digital video signal, wherein the column inputs each receive a control word for this column corresponding to the video word relating, for this column, to the addressed line, this work being made up of n bits transmitted sequentially, each bit triggering or not triggering, depending on its state, the selection of the cell of the addressed line and of the corresponding column for a time proportional to the weight of this bit within the word, wherein all the lines are independently selected for at least one of the bits of the column control word, and wherein at least two lines are simultaneously selected for at least another one of the bits of the column control word relating to the two lines.

2. The method as recited in claim 1, wherein the bit or bits chosen are the two lowest-order bits of the column addressing words and wherein the simultaneously addressed lines are two successive lines.

3. The method as recited in claim 2, wherein the column control word is obtained by transcoding the words which constitute the digital video signal, in such a way that a bit of high weight is replaced by two bits of half weight so as to distribute this high weight over two bits.

4. The method as recited in claim 1, wherein the digital video signals are transcoded into column control words such that at least one of the weights of the column control words is different from a power of two, the word retaining a maximum value equal to that of the words of the video signal, in such a way that at least one word of the video signal can correspond to at least two different column control words, these control words then being chosen as a function of the identity of the bit or bits in respect of which at least two lines are simultaneously addressed.

5. The method as recited in claim 4, wherein when several choices exist, the column control words chosen are those possessing the most one bits and the lowest high-order bits.

6. The method as recited in claim 4, wherein the various weights assigned to the bit of the control words are computed in such a way that the mean number of combinations over the set of values of a word making up the video signal is a maximum.

7. The method as recited in claim 1, wherein the cells are cells of a plasma panel and in that selection involve the illuminating of the cell.

8. The method as recited in claim 1, wherein the cells are micromirrors of a micromirror circuit.

9. A device comprising:

a plasma panel including lines and columns, a video processing circuit for processing the video data received, a corresponding memory for transcoding said data, a video memory for storing the transcoded data, column drivers connected to the columns of the plasma panel, the column drivers being linked to the video memory in order to control the column addressing of the plasma panel on the basis of column control words, a control circuit for the line drivers, wherein the control circuit for the line drivers selects all the lines line-by-line during the transmission by the column drivers of at least one of the bits of the column control words relating to one of these lines, and wherein the control circuit for the line drivers simultaneously selects at least two successive lines during the transmission by the column drives of at least another one of the bits of the column control words relating to these lines.

* * * * *